US011529784B2

(12) United States Patent
Gambino

(10) Patent No.: US 11,529,784 B2
(45) Date of Patent: Dec. 20, 2022

(54) RETROFIT SYSTEMS FOR CONVERTING MANUAL PRESSES TO AUTOMATED PRESSES

(71) Applicant: Joseph Gambino, Sandy, OR (US)

(72) Inventor: Joseph Gambino, Sandy, OR (US)

(73) Assignee: Rogue Fabrication, LLC, Sandy, OR (US)

( * ) Notice: Subject to any disclaimer, the term of this patent is extended or adjusted under 35 U.S.C. 154(b) by 50 days.

(21) Appl. No.: 17/221,711

(22) Filed: Apr. 2, 2021

(65) Prior Publication Data

US 2022/0314569 A1 Oct. 6, 2022

(51) Int. Cl.

*B30B 15/04* (2006.01)
*B30B 1/32* (2006.01)
*B30B 15/18* (2006.01)

(52) U.S. Cl.

CPC ..... *B30B 15/18* (2013.01); *B30B 1/32* (2013.01); *B30B 15/04* (2013.01); *B30B 15/045* (2013.01)

(58) Field of Classification Search

CPC ..... B30B 1/32; B30B 15/04; B30B 15/042; B30B 15/044; B30B 15/045; B30B 15/048; B30B 15/18
USPC ..... 100/269.17; 72/455
See application file for complete search history.

(56) References Cited

U.S. PATENT DOCUMENTS 1,571,622 A * 2/1926 Briggs ..... B30B 15/0029 100/269.01
3,283,699 A * 11/1966 Hawkins ..... B30B 1/32 100/214
3,307,830 A * 3/1967 Van Allen ..... B30B 15/04 100/214
3,495,527 A * 2/1970 Lafreniere ..... B30B 1/32 72/446
3,503,327 A * 3/1970 Lenz ..... B30B 15/04 29/251
4,197,795 A * 4/1980 Hawkins ..... B30B 15/04 29/251
4,283,825 A * 8/1981 McKay ..... B30B 15/04 72/429
4,457,684 A * 7/1984 Gram ..... B30B 15/068 425/149

(Continued)

FOREIGN PATENT DOCUMENTS

CN 202412714 U * 9/2012 ..... B30B 1/32
EP 2141006 A1 * 1/2010 ..... B30B 15/04

*Primary Examiner* — Jimmy T Nguyen
(74) *Attorney, Agent, or Firm* — Mohr IP Law Solutions, PC

(57) ABSTRACT

Retrofit systems for converting a manual press to an automated press. The retrofit systems include a first shaft, a second shaft, a first spacer, and a second spacer. The first shaft is mounted to a first vertical member and is coupled to a first cross member and to a second cross member. The second shaft is mounted to a second vertical member and is coupled to the first cross member and to the second cross member. The first spacer is supported by the first shaft and is disposed between the first vertical member and the first cross member. The second spacer is supported by the second shaft and is disposed between the second vertical member and the first cross member. The first spacer and the second spacer are selected to increase the space between the first cross member and the second cross member to accommodate an automatically actuated press.

19 Claims, 5 Drawing Sheets

(56) References Cited

U.S. PATENT DOCUMENTS

| | | | | |
|---|---|---|---|---|
| 2002/0046661 | A1* | 4/2002 | Hawkins | B30B 15/04<br>100/269.17 |
| 2016/0167329 | A1* | 6/2016 | Martinez Martinez | B30B 15/04<br>29/252 |

* cited by examiner

RETROFIT SYSTEMS FOR CONVERTING MANUAL PRESSES TO AUTOMATED PRESSES

BACKGROUND

The present disclosure relates generally to retrofit systems. In particular, retrofit systems for converting manual presses to automated presses are described.

Presses are utilized extensively in machine and fabrication facilities. Presses allow an operator to stamp, die cut, or otherwise process workpieces. Commonly, presses include a ram, a force multiplier, such as a hydraulic cylinder, and an actuator. Presses can include manually actuated force multipliers or automatically actuated force multipliers. Presses with manually actuated force multipliers are known as manual presses and presses with automatically actuated force multipliers are known as automated presses.

Manual presses are common because they are less expensive and less complex than automated presses. However, manual presses tend to be slow and require more labor than automated presses.

Automated presses are advantageous because they are much faster to operate than manual presses and require less labor. However, automated presses tend to be significantly more expensive than manual presses.

Due to economic factors, many machine and fabrication facilities initially opt to purchase a manual press. Over time, however, facility owners may wish to have an automated press in their facilities. Conventionally, acquiring an automated press requires purchasing a complete automated press to either replace the manual press or to be onsite along with manual press. Purchasing an automated press is economically inefficient given that core aspects of the manual press could still be used effectively to support an automatically actuated press.

It would be desirable to provide a means for facility owners to upgrade their manual presses to automated presses without having to purchase an entirely new automated press. Retrofitting an existing manual press to accommodate an automatically actuated press would be more economically efficient than replacing the existing manual press.

Thus, there exists a need for retrofit systems that convert a manual press to an automated press. Examples of new and useful retrofit systems relevant to the needs existing in the field are discussed below.

United States patent filings with disclosure relevant to retrofit systems include the following U.S. patent filings identified by either patent number, publication number, or application number: U.S. Pat. Nos. 8,342,086; 9,873,187; 10,010,066; 4,559,807; 4,603,573; 4,608,852; 4,656,862; 4,890,475; 6,553,903; and 20160167329. The complete disclosures of these listed U.S. patent filings are herein incorporated by reference for all purposes.

SUMMARY

The present disclosure is directed to retrofit systems for converting a manual press to an automated press. The retrofit systems include a first shaft, a second shaft, a first spacer, and a second spacer. The first shaft is mounted to a first vertical member and is coupled to a first cross member and to a second cross member. The second shaft is mounted to a second vertical member and is coupled to the first cross member and to the second cross member. The first spacer is supported by the first shaft and is disposed between the first vertical member and the first cross member. The second spacer is supported by the second shaft and is disposed between the second vertical member and the first cross member. The first spacer and the second spacer are selected to increase the space between the first cross member and the second cross member to accommodate an automatically actuated press.

DETAILED DESCRIPTION

Figure 1:
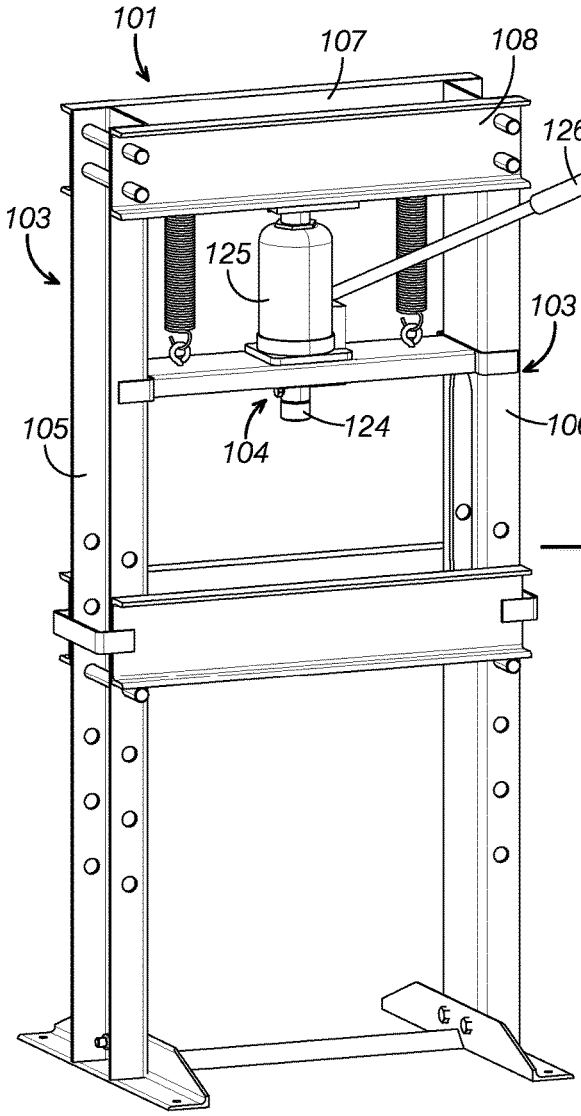
FIG. 1 (PRIOR ART)
FIG. 1 is a perspective view of a prior art manual press.

The disclosed retrofit systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various retrofit systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identity various members of a group, or the like, and are not intended to denote a serial, chronological, or numerical limitation.

"Coupled" means connected, either permanently or releasably, whether directly or indirectly through intervening components.

"Communicatively coupled" means that an electronic device exchanges information with another electronic device, either wirelessly or with a wire-based connector, whether directly or indirectly through a communication network.

"Controllably coupled" means that an electronic device controls operation of another electronic device.

Retrofit Systems for Converting Manual Presses to Automated Presses

With reference to the figures, retrofit systems will now be described. The retrofit systems discussed herein function to convert manual presses to automated presses.

The reader will appreciate from the figures and description below that the presently disclosed retrofit systems address the existing challenges facing machine and fabrication facility owners. For example, the retrofit systems provide a means for facility owners to upgrade their manual presses to automated presses without having to purchase an entirely new automated press. Retrofitting an existing manual press to accommodate an automatically actuated press with the retrofit systems below is more economically efficient than replacing the existing manual press because key components from the manual press can continue to be used.

By converting a manual press to an automated press, the press becomes faster to operate and requires less labor. These advantages are obtained at significantly lower cost with the retrofit systems below than would be required to purchase a new, conventional automated press.

Contextual Details

Ancillary features relevant to the retrofit systems described herein will first be described to provide context and to aid the discussion of the retrofit systems.

Manual Press

The retrofit systems described herein are designed to convert a manual press into an automated press. FIG. 1 depicts one example a manual press suitable for conversion, manual press 101. Manual press 101 is just one example of a manual press that may be converted into an automated press by the retrofit systems described below. The retrofit systems may convert manual presses of different sizes, configurations, and types as well.

As shown in FIG. 1, manual press 101 includes a frame 103 and a manually actuated press assembly 104. In this document, the term manual press refers to the entire press system including the frame and the manually actuated press assembly. The term manually actuated press assembly refers to the ram, force multiplier, and actuator supported on the frame of the manual press.

Manually Actuated Press Assembly

Manually actuated press assembly 104 serves to selectively exert compressive force on workpieces. Manually actuated press assembly 104 includes a ram 124, a force multiplier 125, and an actuator 126. Ram 124 moves in response to pressure exerted on it by force multiplier 125. In the present example, force multiplier 125 is a hydraulic cylinder.

Actuator 126 increases pressure in force multiplier 125 when actuator 126 is manually actuated. More specifically, actuator 126 increases pressure in force multiplier 125 when a user manually manipulates actuator 126 up and down to pump force multiplier 125.

The size of the manually actuated assembly press may be varied as needed for a given application. In some examples, the manually actuated press assembly is larger relative to the other components than depicted in the figures. In other examples, the manually actuated press assembly is smaller relative to the other components than depicted in the figures. Further, the reader should understand that the manually actuated press assembly and the other components may all be larger or smaller than described herein while maintaining their relative proportions.

The manually actuated press assembly may be any currently known or later developed type of manually actuated press assembly or device. The reader will appreciate that a variety of manually actuated press assembly types exist and could be in use in a manual press in place of the manually actuated press assembly shown in the figures. In addition to the types of manually actuated press assemblies existing currently, it is contemplated that the retrofit systems described herein could be used to replace manually actuated press assemblies developed in the future.

Frame

Frame 103 functions to support manually actuated press assembly 104 and workpieces being processed by the press assembly. As explained below, after retrofitting manual press 101 with retrofit system 100, frame 103 supports automatically actuated press assembly 113 instead of manually actuated press assembly 104.

The reader can see in FIG. 1 that frame 103 includes a first vertical member 105, a second vertical member 106, a first cross member 107, and a second cross member 108. As depicted in FIG. 1, second vertical member 106 is horizontally spaced from first vertical member 105. Other frame configurations are possible and the retrofit systems described below may accommodate a wide variety of frame configurations.

The reader can see in FIG. 1 that second cross member 108 is spaced from first cross member 107. In particular, second cross member 108 and first cross member 107 are spaced to accommodate manually actuated press 104. As shown in FIG. 1, second cross member 108 is supported by and spans between first vertical member 105 and second vertical member 106. With reference to FIG. 1, first cross member 107 is supported by and spans between first vertical member 105 and second vertical member 106.

In some examples of the retrofit systems below, the retrofit system utilizes the existing cross members of the frame when converting the manual press to an automated press. In other examples, the retrofit system includes cross members configured differently than the existing cross members, such as first cross member 137 and second cross member 138 shown in FIGS. 2-6, to replace the existing cross members of the frame. The differently configured cross members may be selected to accommodate automatically actuated press assemblies that are a different size or shape than the manually actuated press assembly being replaced.

Automated Press

Automated press 102 functions to selectively exert compressive force on workpieces without requiring a user to manually actuate an actuator. In the example shown in FIG. 2, automated press 102 includes an automatically actuated press assembly 113 and frame 103.

The size of the automated press may be varied as needed for a given application. In some examples, the automated press is larger relative to the other components than depicted in the figures. In other examples, the automated press is smaller relative to the other components than depicted in the figures. Further, the reader should understand that the automated press and the other components may all be larger or smaller than described herein while maintaining their relative proportions.

The automated press may be any currently known or later developed type of automated press incorporating the retrofit systems described herein. The reader will appreciate that a variety of automated press types exist and could be used in place of the automated press shown in the figures. In addition to the types of automated presses existing currently, it is contemplated that the retrofit systems described herein could incorporate new types of automated presses developed in the future.

Automatically Actuated Press Assembly

Figure 2:
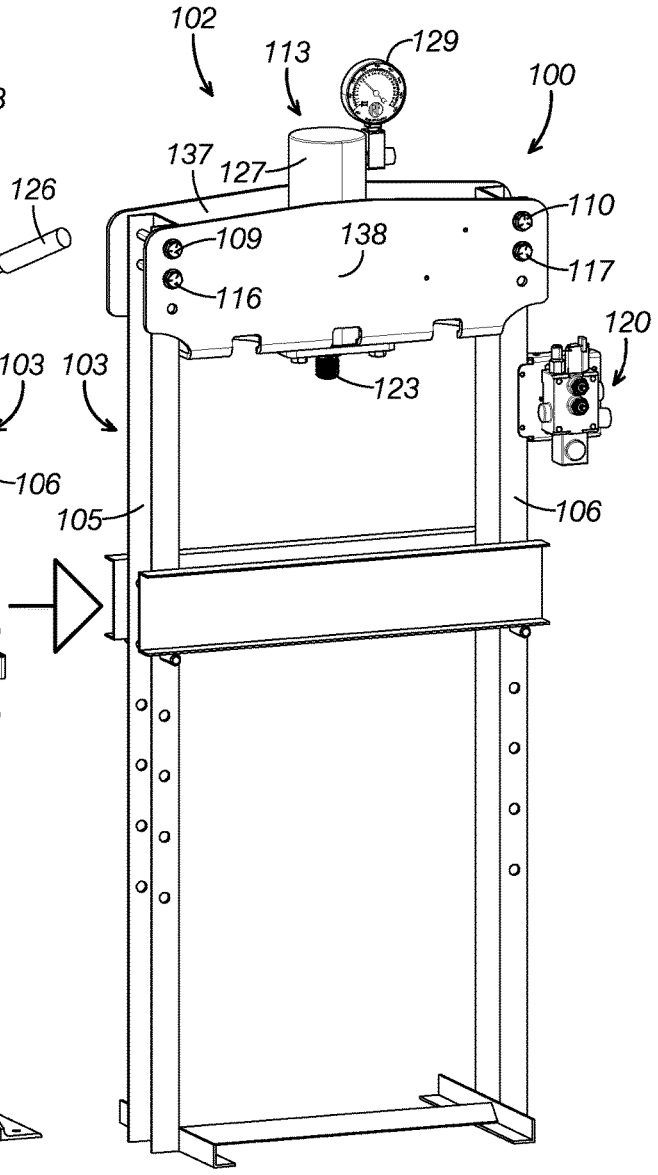
FIG. 2 is a perspective view of a retrofit system installed on a frame of the manual press shown in FIG. 1 to convert the manual press to an automated press.
Figure 5:
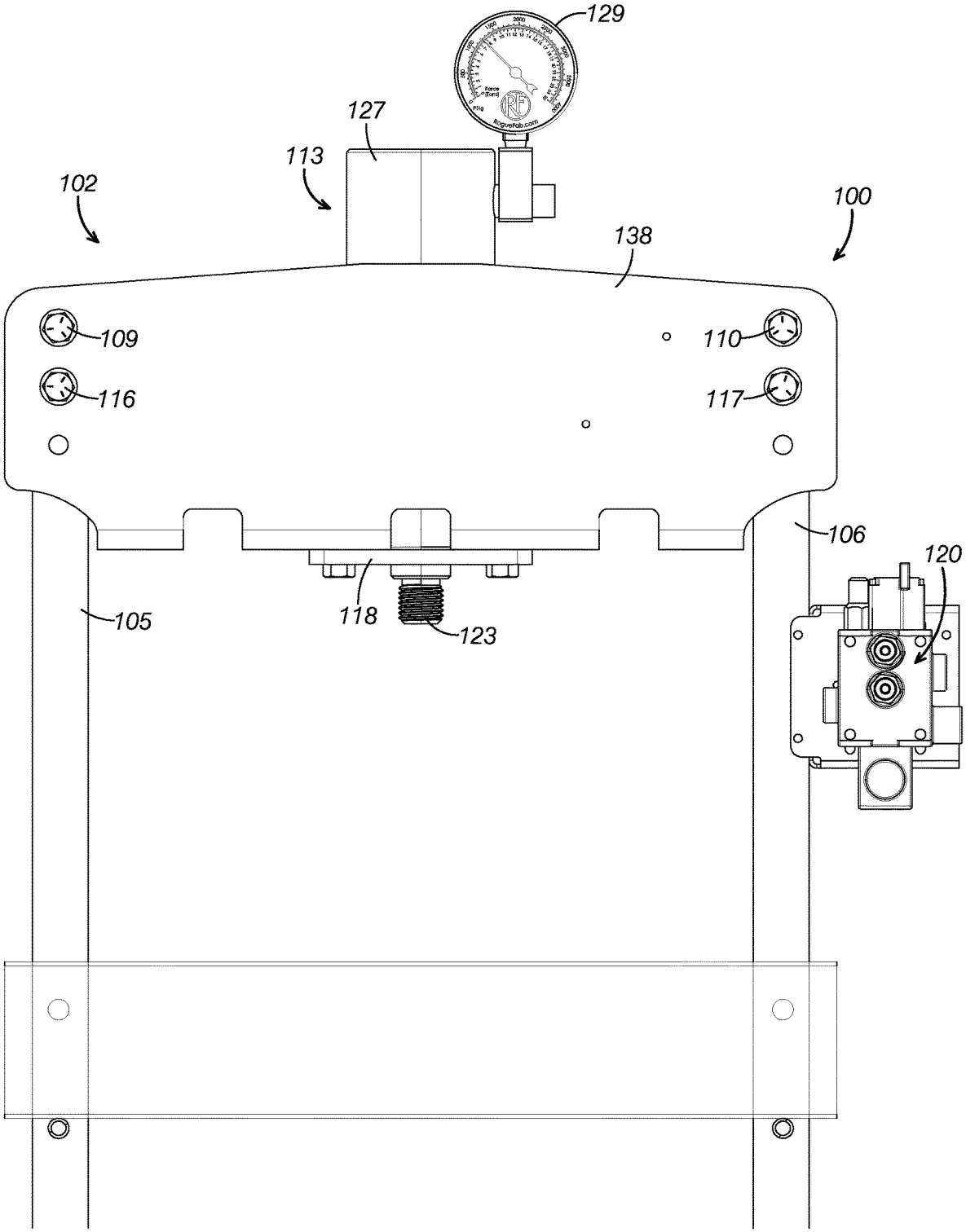
FIG. 5 is a front elevation view of the retrofit system shown in FIG. 1.

Automatically actuated press assembly 113 functions to selectively compress a workpiece without require a user to manually actuate it. As shown in FIGS. 2 and 5, automatically actuated press assembly 113 includes a ram 123, a force multiplier 127, an actuator (not pictured), and a gauge 129.

As shown in FIGS. 2-6, automatically actuated press assembly 113 is coupled to first cross member 137 and to second cross member 138 via a bracket 118 in a position between first cross member 137 and second cross member 138. With reference to FIGS. 1 and 2, automatically actuated press 113 is larger than manually actuated press assembly 104 and requires more space between the first cross member and the second cross member than manually actuated press assembly 104.

Ram

Ram 123 serves to selectively deliver compressive force supplied by force multiplier 127 to a workpiece supported on frame 103. The reader can see in FIG. 5 that ram 123 is supported and driven by force multiplier 127. Ram 123 is configured to extend and retract from force multiplier 127 in response to user inputs to a controller 120.

The ram may be any currently known or later developed type of ram. The reader will appreciate that a variety of ram types exist and could be used in place of the ram shown in the figures. In addition to the types of rams existing currently, it is contemplated that the automatically actuated press assemblies described herein could incorporate new types of rans developed in the future.

The size of the ram may be varied as needed for a given application. In some examples, the ram is larger relative to the other components than depicted in the figures. In other examples, the ram is smaller relative to the other components than depicted in the figures. Further, the reader should understand that the ram and the other components may all be larger or smaller than described herein while maintaining their relative proportions.

Force Multiplier

In the example depicted in the figures, force multiplier 127 is a two-way hydraulic cylinder. However, the force multiplier may be any currently known or later developed type of force multiplier, such as motorized screws or pneumatic systems. The reader will appreciate that a variety of force multiplier types exist and could be used in place of the force multiplier shown in the figures. In addition to the types of force multipliers existing currently, it is contemplated that the automatically actuated press assemblies described herein could incorporate new types of force multipliers developed in the future.

With reference to FIGS. 2 and 5, force multiplier 127 is rated to produce 3,000 pounds per square inch of pressure. However, the size of the force multiplier may be varied as needed for a given application. In some examples, the force multiplier is larger relative to the other components than depicted in the figures. In other examples, the force multiplier is smaller relative to the other components than depicted in the figures. Further, the reader should understand that the force multiplier and the other components may all be larger or smaller than described herein while maintaining their relative proportions.

Actuator

In the example depicted in FIGS. 2 and 5, the actuator is a hydraulic power supply (not pictured) supplying hydraulic fluid through hydraulic tubing (not pictured) to force multiplier 127 through controller 120. In other examples, the actuator is a pneumatic system receiving a supply of compressed air from an air compressor via pneumatic tubing. In still other examples, the actuator is a motor powered by a supply of electricity.

In the example shown in FIGS. 2-6, hydraulic tubing fluidly couples the hydraulic power supply to force multiplier 127. The hydraulic fluid supplied by the hydraulic power supply actuates force multiplier 127. Controller 120 is disposed between the hydraulic power supply and force multiplier 127 to selectively control the flow of hydraulic fluid from the hydraulic power supply to force multiplier 127.

The hydraulic power supply may include a motor, a fluid reservoir, and a pump. The hydraulic power supply may be designed specifically for a particular hydraulic cylinder force multiplier included in a given automated press or may be a general hydraulic power supply suitable for actuating a variety of hydraulic cylinder force multipliers. The size of the hydraulic power supply may be varied as needed for a given application.

The actuator may be any currently known or later developed type of actuator, such as hydraulic systems, pneumatic systems, solenoids, and motors. The reader will appreciate that a variety of actuator types exist and could be used in place of the actuator shown in the figures. In addition to the types of actuators existing currently, it is contemplated that the automatically actuated press assemblies described herein could incorporate new types of actuators developed in the future.

Pressure Gauge

In the example shown in the figures, gauge 129 functions to detect and display the compressive force being applied by ram 123. The gauge is an optional feature not present in all examples of the automatically actuated press assembly. In the present example, the gauge displays compressive force as pressure reading. However, in other examples, the gauge may additionally or alternatively display compressive force as simply a force.

The gauge may be any currently known or later developed type of gauge, such as analogue and digital gauges. The reader will appreciate that a variety of gauge types exist and could be used in place of the gauge shown in the figures. In addition to the types of gauges existing currently, it is contemplated that the automatically actuated press assemblies described herein could incorporate new types of gauges developed in the future.

Retrofit System

With reference to FIGS. 1-6, a retrofit system 100 will now be described as a first example of a retrofit system. As shown in FIGS. 1 and 2, retrofit system 100 converts a manual press 101 to an automated press 102.

The reader can see in FIGS. 3-6 that retrofit system 100 includes a first shaft 109, a second shaft 110, a first spacer 111, a second spacer 112, a third spacer 114, a fourth spacer 115, a third shaft 116, a fourth shaft 117, a bracket 118, and a controller 120. In other examples, the retrofit system includes fewer components than depicted in the figures, such as fewer shafts or spacers, no shafts or spacers, or not including a controller. In certain examples, the retrofit system includes additional or alternative components than depicted in the figures, such as a hydraulic power supply and/or customized cross members obviating the need for spacers.

Shafts

The shafts functions to support the cross members on frame 103 and to couple them to the vertical members of frame 103. First shaft 109, second shaft 110, third shaft 116, and fourth shaft 117 are all coupled to first cross member 137 and to second cross member 138.

Figure 3:
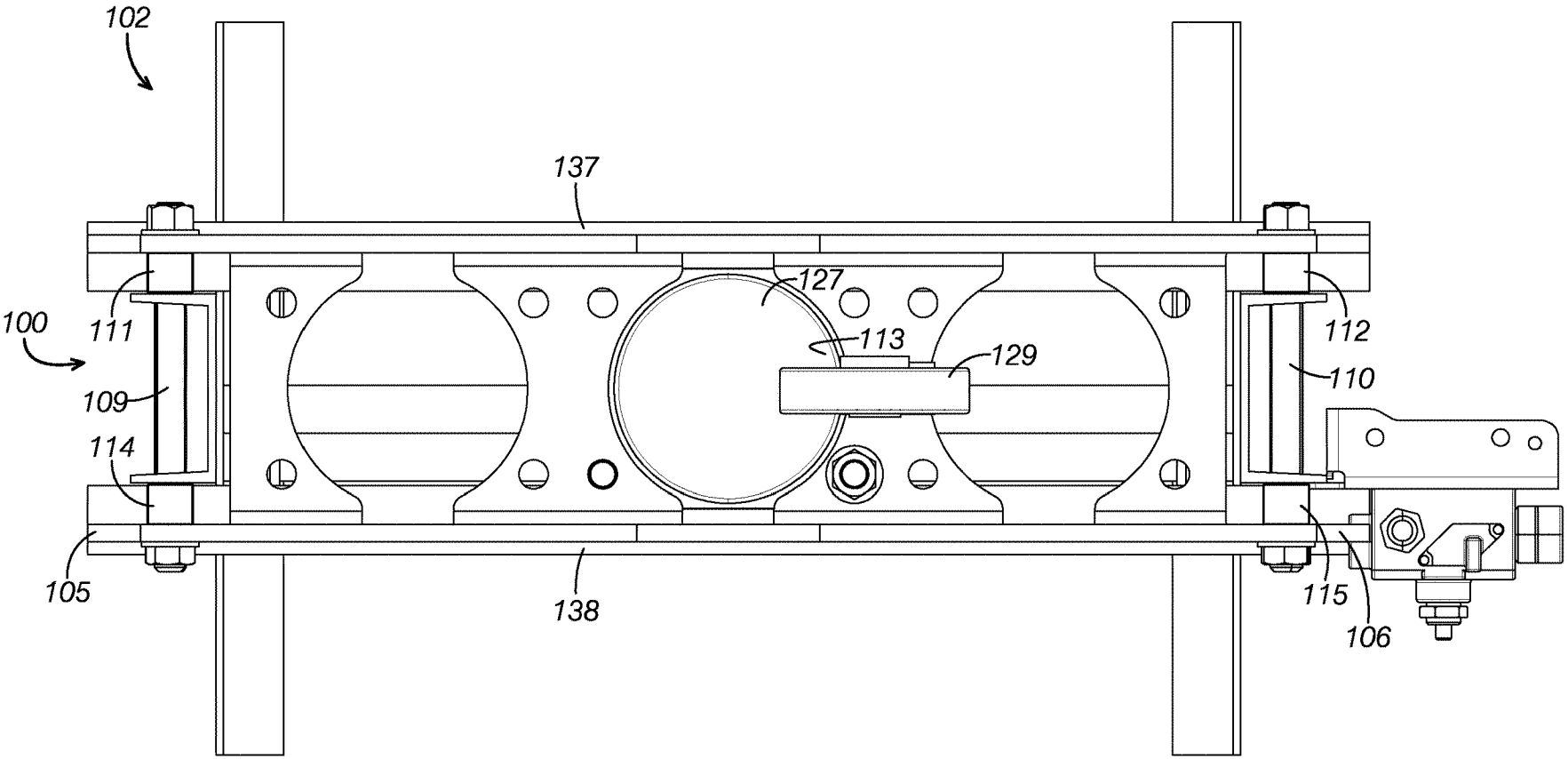
FIG. 3 is a top view of the retrofit system shown in FIG. 1 mounted on the frame.
Figure 4:
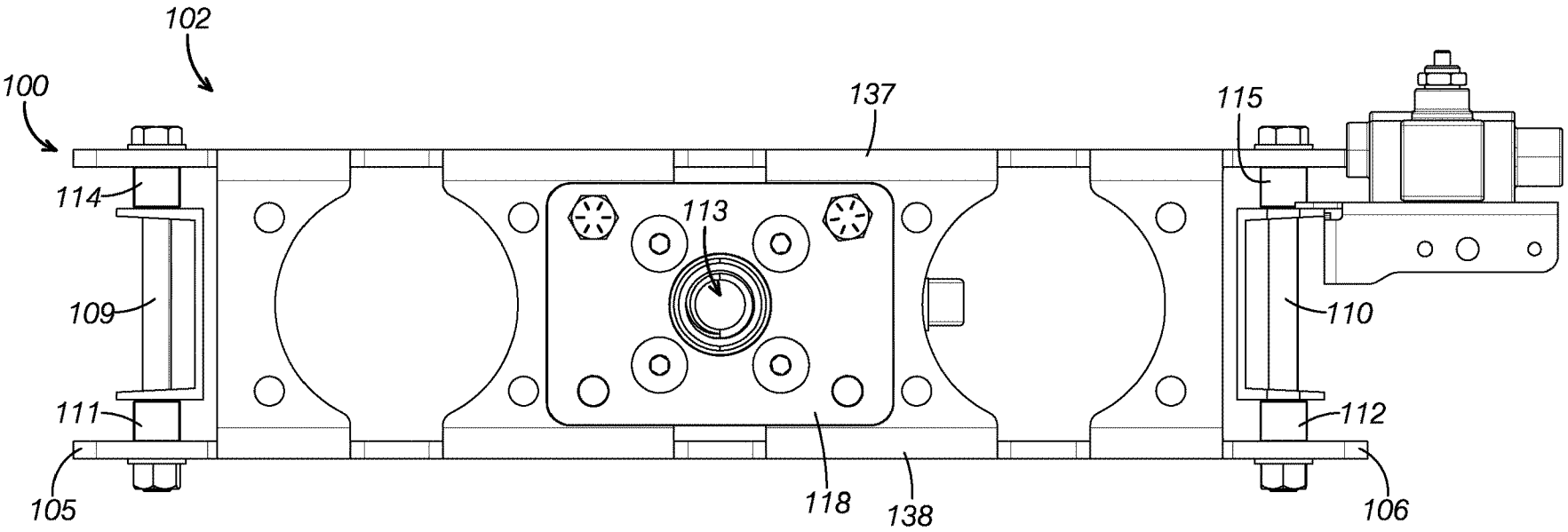
FIG. 4 is a bottom view of the retrofit system shown in FIG. 1
Figure 6:
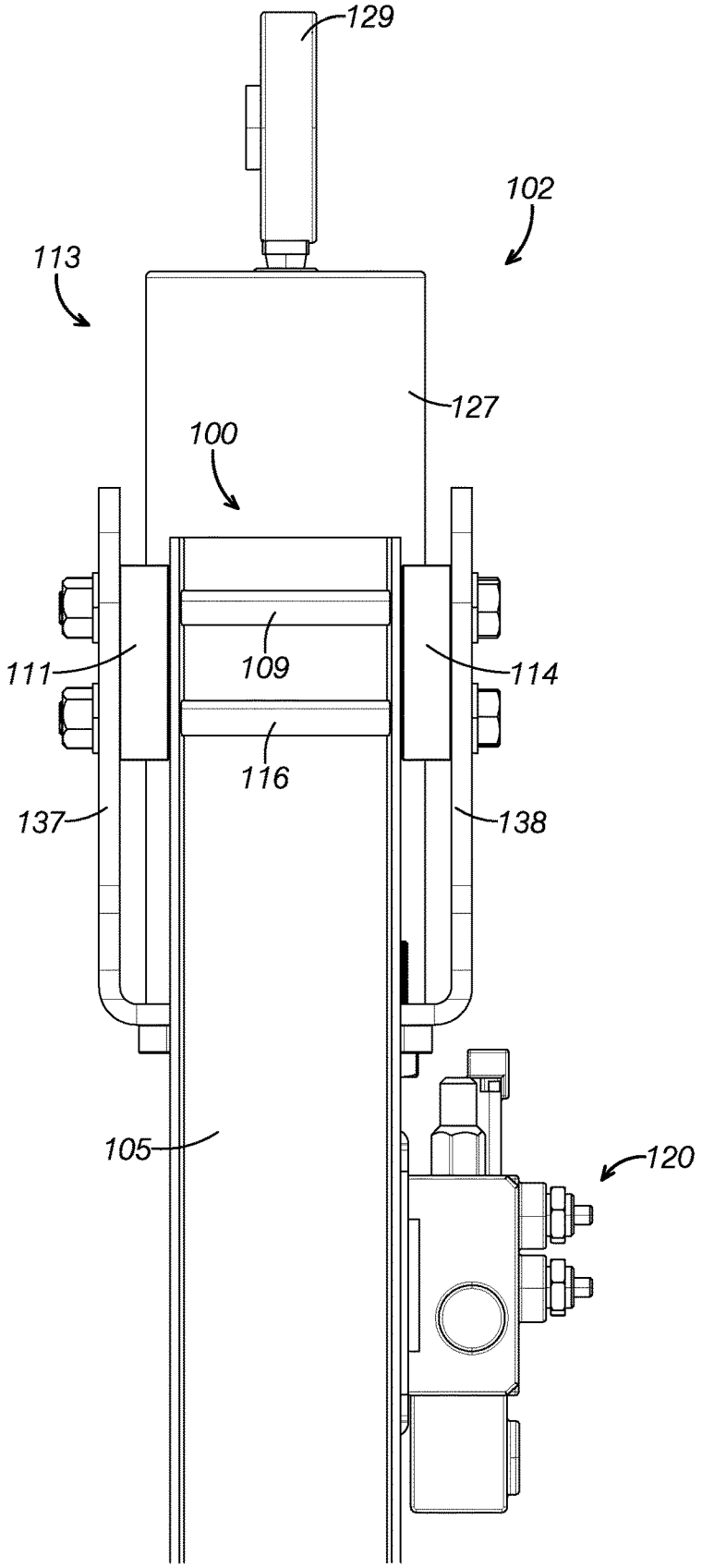
FIG. 6 is a left side elevation view of the retrofit system shown in FIG. 1.

As depicted in FIGS. 3-6, first shaft 109 is mounted to first vertical member 105. The reader can see in FIGS. 3-5 that second shaft 110 is mounted to second vertical member 106. As depicted in FIGS. 3, 4, and 6, third shaft 116 is mounted to first vertical member 105 in a position spaced from first shaft 109. As shown in FIGS. 3 and 4, fourth shaft 117 is mounted to second vertical member 106 in a position spaced from second shaft 110.

With reference to FIGS. 3-6, first shaft 109, second shaft 110, third shaft 116, and fourth shaft 117 are bolts. However, the shafts may be any currently known or later developed type of shaft. The reader will appreciate that a variety of shaft types exist and could be used in place of the shafts shown in the figures. In addition to the types of shafts existing currently, it is contemplated that the retrofit systems described herein could incorporate new types of shafts developed in the future.

The size of the shafts may be varied as needed for a given application. In some examples, the shafts are larger relative to the other components than depicted in the figures. In other examples, the shafts are smaller relative to the other components than depicted in the figures. Further, the reader should understand that the shafts and the other components may all be larger or smaller than described herein while maintaining their relative proportions.

In the present example, the shafts are composed of metal. However, the shafts may be composed of any currently known or later developed material suitable for the applications described herein for which they are used. Suitable materials include metals, polymers, ceramics, wood, and composite materials.

Spacers

The spacers serve to increase the space between first cross member 137 and second cross member 138 to accommodate automatically actuated press assembly 113. In some examples, the spacers are not included and instead the retrofit system includes cross members with spacing sufficient to accommodate the automatically actuated press assembly directly coupled to the vertical members.

As shown in FIGS. 3, 4, and 6, first spacer 111 is supported by first shaft 109 and is disposed between first vertical member 105 and first cross member 137. Second spacer 112 is supported by second shaft 110 and disposed between second vertical member 106 and first cross member 137. As depicted in FIGS. 3, 4, and 6, third spacer 114 is supported by first shaft 109 and disposed between first vertical member 105 and second cross member 138. With reference to FIGS. 3 and 4, fourth spacer 115 is supported by second shaft 110 and disposed between second vertical member 106 and second cross member 138.

With reference to FIGS. 3, 4, and 6, first spacer 111, second spacer 112, third spacer 114, and fourth spacer 115 are selected to collectively increase the space between first cross member 137 and second cross member 138 sufficient to accommodate automatically actuated press assembly 113. The reader can see in FIGS. 3, 4, and 6 that first spacer 111 and second spacer 112 cooperate on opposite ends of the cross members to increase the space between first cross member 137 and second cross member 138. As depicted in FIGS. 3, 4, and 6, first spacer 111 and third spacer 114 cooperate on the same end of the cross members from opposite sides of first vertical member 105 to collectively increase the space between first cross member 137 and second cross member 138.

The number of spacers in the retrofit system may be selected to meet the needs of a given application. The reader should understand that the number of spacers may be different in other examples than is shown in the figures. For instance, some retrofit system examples include additional or fewer first spacers than described in the present example, such as just two spacers or more than four spacers.

The shape of the spacers may be adapted to be different than the specific examples shown in the figures to suit a given application. For example, one or more of the spacers may include a face having the shape of a regular or irregular polygon, such as a circle, oval, triangle, square, rectangle pentagon, and the like. Additionally or alternatively, the spacers may include a face having an irregular shape. In three dimensions, the shape of the spacers may be a sphere, a pyramid, a cone, a cube, and variations thereof, such as a hemisphere or a frustoconical shape.

In the present example, the spacers are composed of metal. However, the spacers may be composed of any currently known or later developed material suitable for the applications described herein for which they are used. Suitable materials include metals, polymers, ceramics, wood, and composite materials.

The spacer may be any currently known or later developed type of spacer. The reader will appreciate that a variety of spacer types exist and could be used in place of the spacers shown in the figures. In addition to the types of spacers existing currently, it is contemplated that the retrofit systems described herein could incorporate new types of spacers developed in the future.

The size of the spacers may be varied as needed for a given application. In some examples, one or more of the spacers is larger relative to the other components than depicted in the figures. In other examples, the one or more of the spacers is smaller relative to the other components than depicted in the figures. Further, the reader should understand that the spacers and the other components may all be larger or smaller than described herein while maintaining their relative proportions.

Controller

Controller 120 functions to selectively allow the actuator to actuate force multiplier 127. More particularly, controller 120 is configured to selectively control the flow of hydraulic fluid from the hydraulic power supply to force multiplier 127 of automatically actuated press assembly 113. As depicted in FIGS. 2-6, controller 120 is disposed between the hydraulic power supply and force multiplier 127 to control the flow of hydraulic fluid to force multiplier 127.

The controller may be any currently known or later developed type of controller. The reader will appreciate that a variety of controller types exist and could be used in place of the controller shown in the figures. In addition to the types of controllers existing currently, it is contemplated that the retrofit systems described herein could incorporate new types of controllers developed in the future.

Bracket

As depicted in FIGS. 4-6, bracket 118 supports automatically actuated press assembly 113 and couples it to frame 103. The reader can see in FIGS. 4-6 that bracket 118 is coupled to first cross member 137 and to second cross member 138 in a position between first cross member 137 and second cross member 138. In the present example, bracket 118 supports force multiplier 127 and allows ram 123 to extend below bracket 118 toward a work-piece supported on frame 103.

In the present example, bracket 118 is composed of metal. However, the bracket may be composed of any currently known or later developed material suitable for the applications described herein for which it is used. Suitable materials include metals, polymers, ceramics, wood, and composite materials.

The bracket may be any currently known or later developed type of bracket. The reader will appreciate that a variety of bracket types exist and could be used in place of the bracket shown in the figures. In addition to the types of brackets existing currently, it is contemplated that the retrofit systems described herein could incorporate new types of brackets developed in the future.

The shape of the bracket may be adapted to be different than the specific examples shown in the figures to suit a given application. For example, the bracket may include a face having the shape of a regular or irregular polygon, such as a circle, oval, triangle, square, rectangle pentagon, and the like. Additionally or alternatively, the bracket may include a face having an irregular shape. In three dimensions, the shape of the bracket may be a sphere, a pyramid, a cone, a cube, and variations thereof, such as a hemisphere or a frustoconical shape.

The size of the bracket may be varied as needed for a given application. In some examples, the bracket is larger relative to the other components than depicted in the figures. In other examples, the bracket is smaller relative to the other components than depicted in the figures. Further, the reader should understand that the bracket and the other components may all be larger or smaller than described herein while maintaining their relative proportions.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A retrofit system for converting a manual press to an automated press, the manual press having a frame configured to support a manually actuated press assembly, the frame including a first vertical member, a second vertical member horizontally spaced from the first vertical member, a first cross member supported by and spanning between the first vertical member and the second vertical member, and a second cross member spaced from the first cross member and supported by and spanning between the first vertical member and the second vertical member, the second cross member and the first cross member spaced to accommodate the manually actuated press assembly, the retrofit system comprising:

a first shaft mounted to the first vertical member and coupled to the first cross member and to the second cross member;

a second shaft mounted to the second vertical member and coupled to the first cross member and to the second cross member;

a first spacer supported by the first shaft and disposed between the first vertical member and the first cross member; and a second spacer supported by the second shaft and disposed between the second vertical member and the first cross member;

wherein the first spacer and the second spacer are selected to increase the space between the first cross member and the second cross member to accommodate an automatically actuated press assembly.

2. The retrofit system of claim 1, wherein the automatically actuated press assembly is larger than the manually actuated press assembly and requires more space between the first cross member and the second cross member.

3. The retrofit system of claim 1, wherein:

the retrofit system further comprises a third spacer supported by the first shaft and disposed between the first vertical member and the second cross member;

the first spacer and the third spacer are selected to collectively increase the space between the first cross member and the second cross member to accommodate the automatically actuated press assembly.

4. The retrofit system of claim 3, wherein:

the retrofit system further comprises a fourth spacer supported by the second shaft and disposed between the second vertical member and the second cross member;

the first spacer, the second spacer, the third spacer, and the fourth spacer are selected to collectively increase the space between the first cross member and the second cross member to accommodate the automatically actuated press assembly.

5. The retrofit system of claim 1, further comprising a third shaft mounted to the first vertical member in a position spaced from the first shaft, the third shaft coupled to the first cross member and to the second cross member.

6. The retrofit system of claim 5, further comprising a fourth shaft mounted to the second vertical member in a position spaced from the second shaft, the fourth shaft coupled to the first cross member and to the second cross member.

7. The retrofit system of claim 1, further comprising the automatically actuated press assembly operatively coupled to the first cross member and to the second cross member in a position between the first cross member and the second cross member.

8. The retrofit system of claim 7, further comprising a bracket supporting the automatically actuated press assembly and coupled to the first cross member and to the second cross member in a position between the first cross member and the second cross member.

9. The retrofit system of claim 7, further comprising a controller operatively connected to the automatically actuated press assembly, the controller configured to selectively allow the automatically actuated press assembly to be actuated.

10. The retrofit system of claim 7, wherein the automatically actuated press assembly includes:

a force multiplier; and a ram driven by the force multiplier and configured to extend and retract from the force multiplier.

11. The retrofit system of claim 10, wherein the force multiplier includes a hydraulic cylinder.

12. The retrofit system of claim 11, wherein the force multiplier is hydraulically actuated.

13. The retrofit system of claim 12, wherein the force multiplier is rated to produce 3,000 pounds per square inch of pressure.

14. The retrofit system of claim 1, wherein the first shaft is a bolt.

15. A retrofit system for converting a manual press to an automated press, the manual press having a frame configured to support a manually actuated press assembly, the frame including a first vertical member and a second vertical member horizontally spaced from the first vertical member, the retrofit system comprising:

a first shaft mounted to the first vertical member;

a second shaft mounted to the second vertical member;

a first cross member spanning between the first vertical member and the second vertical member and supported by the first shaft and the second shaft;

a second cross member spaced from the first cross member, the second cross member spanning between the first vertical member and the second vertical member and supported by the first shaft and the second shaft;

a first spacer supported by the first shaft and disposed between the first vertical member and the first cross member;

wherein the second cross member and the first cross member are spaced to accommodate an automatically actuated press assembly.

16. The retrofit system of claim 15, further comprising a second spacer supported by the second shaft and disposed between the second vertical member and the first cross member.

17. The retrofit system of claim 15, further comprising the automatically actuated press assembly operatively coupled to the first cross member and to the second cross member in a position between the first cross member and the second cross member.

18. The retrofit system of claim 17, further comprising a bracket supporting the automatically actuated press assembly and coupled to the first cross member and to the second cross member in a position between the first cross member and the second cross member.

19. The retrofit system of claim 17, wherein the automatically actuated press assembly includes a force multiplier comprising a hydraulic cylinder.

* * * * *